United States Patent [19]

Kulesza et al.

[11] Patent Number: 4,550,876

[45] Date of Patent: Nov. 5, 1985

[54] SPRINKLER TOY

[75] Inventors: Ralph J. Kulesza, Chicago; Donald A. Rosenwinkel, Oak Park; Harry Disko, So. Barrington, all of Ill.

[73] Assignee: Marvin Glass & Associates, Chicago, Ill.

[21] Appl. No.: 440,978

[22] Filed: Nov. 12, 1982

[51] Int. Cl.[4] ..... A63H 23/10

[52] U.S. Cl. ..... 239/211; 446/483; 239/279; 239/444; D23/9

[58] Field of Search ..... 46/41, 91, 92; 272/1 B; D23/6, 9, 10; 239/211, 289, 443, 444, 436, 273, 275, 276, 279

[56] References Cited

U.S. PATENT DOCUMENTS

| | | | |
|---|---|---|---|
| 2,030,605 | 2/1936 | Moore | 46/41 X |
| 2,270,595 | 1/1942 | Lewis | 239/443 |
| 2,598,961 | 6/1952 | Andrus | 239/562 X |
| 2,829,379 | 4/1958 | McGee | 239/569 X |
| 2,884,200 | 4/1959 | Konikson | 239/211 X |
| 3,178,116 | 4/1965 | Cucuzza et al. | 239/211 |
| 4,203,551 | 5/1980 | Levine | 239/444 X |

*Primary Examiner*—Andres Kashnikow

[57] ABSTRACT

A sprinkler toy, advantageously in the shape of a fire hydrant, includes a connector for placing the toy in fluid communication with a garden hose. A first spraying nozzle is capable of communicating with the connector through a pivotally operated valve. The first nozzle includes a plurality of apertures for producing an upwardly directed, diffused liquid spray. A second nozzle, also capable of fluid communication with the connector through a pivotally operated valve, is connected to the remainder of the toy by a flexible hose.

14 Claims, 3 Drawing Figures

SPRINKLER TOY

BACKGROUND OF THE INVENTION

1. Field of the Invention

This invention relates generally to sprinkler toys.

2. Brief Description of the Background Art

Sprinkler play, using conventional lawn sprinklers, has been a popular summer pastime for years. Entertaining sprinkler toys are known which are specifically designed for use as a child's toy. However, there is a continuing demand for new and more stimulating sprinkler toys which facilitate, encourage, and stimulate sprinkler play.

SUMMARY OF THE INVENTION

It is a primary object of the present invention to provide a sprinkler toy which enhances sprinkler play.

This and other objects of the present invention are achieved by a sprinkler toy with a housing and a connector means on the housing for connecting the housing to a garden hose. A diffusing nozzle means, mounted on the housing, is capable of fluid communication with the connector means. The nozzle means sprays liquid outwardly in a diffuse spray from the housing. A flexible hose is mounted on the housing and extends away therefrom. The hose is capable of fluid communication with the connector means as well.

DETAILED DESCRIPTION OF THE PREFERRED EMBODIMENT

Figure 1:
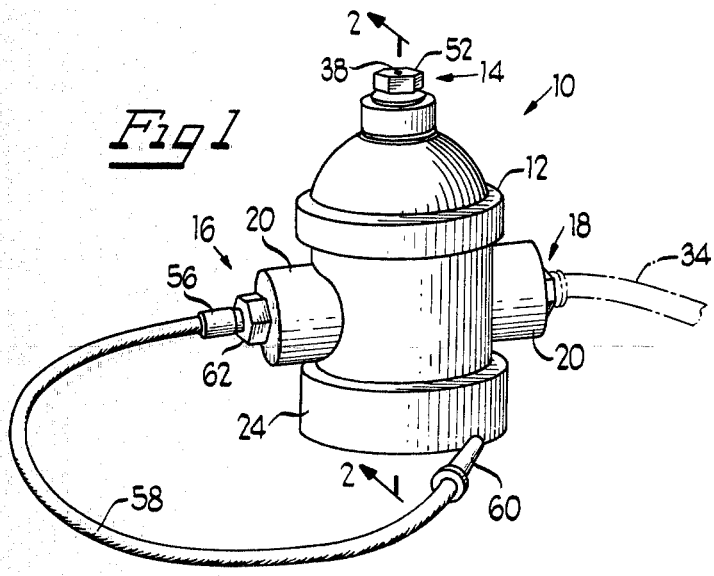
FIG. 1 is a perspective view of one embodiment of the present invention.
Figure 3:
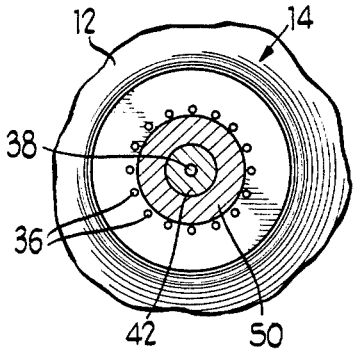
FIG. 3 is a cross-sectional view taken generally along the line 3—3 in FIG. 2.

Referring to the drawing wherein like reference characters are used for like parts throughout the several views, a sprinkler toy 10, shown in FIG. 1, includes a housing 12 advantageously in the general shape of a fire hydrant. Conveniently, the housing 12 is formed as an enclosure by conventional plastic molding techniques. The housing 12 includes a first nozzle 14, a second nozzle 16, and a garden hose connector 18. Conveniently, the garden hose connector 18 is situated on one outwardly extending arm 20 of the housing 12 while the second nozzle 16 extends outwardly from the other arm 20 and the first nozzle 14 extends in an upwardly directed configuration from the top of the housing 12. An enlarged, closed base 24 supports the housing 12 in an upstanding configuration.

Figure 2:
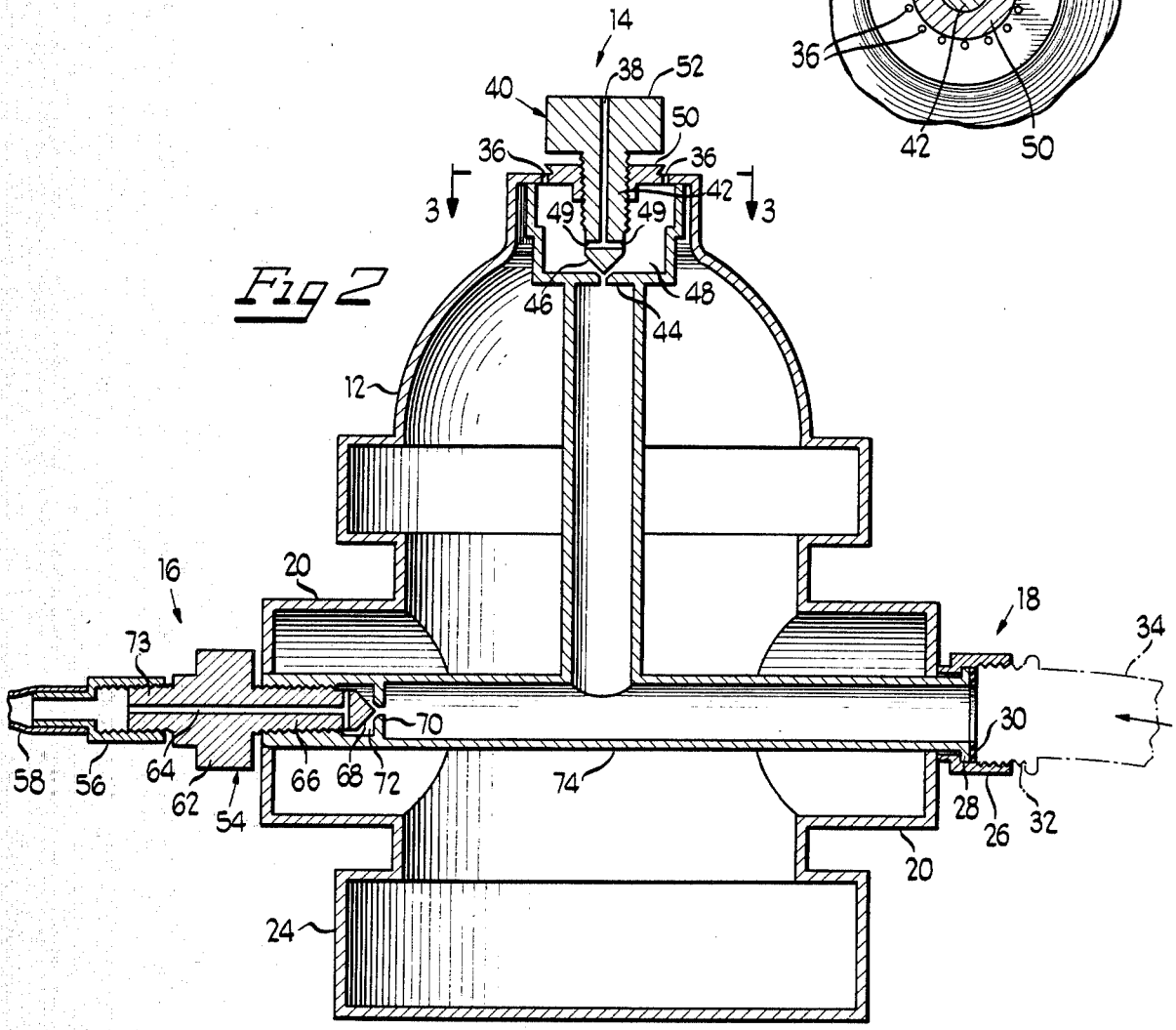
FIG. 2 is an enlarged, cross-sectional view taken generally along the line 2—2 in FIG. 1.

Referring to FIG. 2, the connector 18 is generally in the form of a conventional twist-type female garden hose connector including a rotatable threaded sleeve 26, an outwardly turned flange 28 and a washer 30. The sleeve 26 may be rotated to thread it onto the male portion 32 of a garden hose 34. The sleeve 26 is held captive by the flange 28 while the washer 30 provides a liquid tight seal between the connector 18 and the hose 34.

The first nozzle 14 includes a circular array of liquid diffusing apertures 36, a T-shaped central aperture 38, and a rotatably operated valve 40. The valve 40 includes a T-shaped threaded member 42 which threads in and out of the housing 12 to mate with and move away from its seat 44. With the pointed end 46 of the member 42 positioned against the seat 44, the valve 40 is in its closed position. This is because access to the chamber 48 and thus to the apertures 36 and the aperture 38 inlets 49, which are spaced upwardly from the pointed end 46, is cut off. When the pointed end 46 is spaced from the seat 44, as shown in FIG. 2, the valve 40 is open and liquid flow is possible through the circular array of apertures 36 and the central aperture 38 by way of a chamber 48. An angled spray deflector 50 is arranged adjacent and slightly over the apertures 36 to deflect the spray through the apertures 36 outwardly of the housing at an angle of approximately 45 degrees. The spray through the central aperture 38, however, is directed straight upwardly. The member 42 includes an exposed, hexagonal or nut-shaped head 52 which may be rotated by the user to open or close the valve 40.

The second nozzle 16 includes a rotatably operated valve 54, a hose adaptor 56, a hose 58 and a hose head 60. The valve 54 includes an exposed, hexagonal or nut-shaped head 62 that is arranged to be manually accessible and includes a T-shaped internal passage 64. The head 62 is connected to a threaded member 66 which threads into the housing 12 to vary the relationship between the pointed end 68 of the member 66 and the valve seat 70. Again, when the end 68 is pressed against the valve seat 70, the valve is closed and no liquid flow through the passage 64 occurs. However, when the pointed end 68 is spaced from the valve seat 70, liquid may flow into the chamber 72 and through the passage 64. The adaptor 56 threadingly engages the extension 73 of the valve 54 on one end and is frictionally connected to the hose 58 on the other end. The free end of the hose 58 is attached to the manually graspable hose head 60. The head 60 may be a conventional spray adjustible garden hose-type of nozzle.

Liquid communication may be established between the connector 18, the first nozzle 14 and second nozzle 16 by way of an internal T-shaped passage 74. Thus, when the valve 40 is open, liquid communication between the connector 18 and the first nozzle 14 is possible, and when the valve 54 is open, liquid communication between the connector 18 and the second nozzle 16 is possible. The liquid exits from the nozzle 14 in a diffused spray directed generally upwardly. However, the liquid exits from the nozzle 16 in a direction determined by the user through the orientation of the flexible hose 58.

While the present invention has been described with respect to a single preferred embodiment, those skilled in the art will appreciate that a number of modifications are possible and it is intended to cover within the appended claims all such modifications as are within the true spirit and scope of the present invention.

What is claimed and desired to be secured by Letters Patent of the United States is:

1. A sprinkler toy comprising:

a portable, generally upright cylindrical housing having a top and a bottom;

connector means on said housing for connecting said housing to a garden hose;

upwardly directed diffusing nozzle means, mounted in the top of said housing and capable of fluid communication with said connector means, for spraying liquid outwardly in a diffuse spray from said housing; and a flexible hose having a connected end and a free exit end mounted on said housing only at said connected end intermediate said top and bottom and being extendable by the user away from said housing, said hose capable of fluid communication with said connector means.

2. The toy of claim 1 including valve means for controlling the fluid communication between said connector means and said diffusing nozzle means and said flexible hose.

3. The toy of claim 2 wherein said valve means includes a rotatably operable valve.

4. The toy of claim 2 wherein said valve means for controlling the fluid communication between said connector means and said flexible hose is adjacent one end of said hose.

5. The toy of claim 3 including a rotatably operable valve controlling the operation of said nozzle means and another rotatably operable valve controlling the fluid flow through said hose.

6. The toy of claim 5 wherein said valves include manually rotatable, generally hexagonally shaped valve operators.

7. The toy of claim 5 wherein said another rotatably operable valve controlling the fluid flow through said hose is adjacent one end of said hose.

8. The toy of claim 1 wherein said housing is generally in the shape of a fire hydrant.

9. The toy of claim 1 wherein said diffusing nozzle means includes a nozzle directed generally upwardly with respect to said housing and said flexible hose is mounted to extend horizontally outwardly of said housing.

10. The toy of claim 1 wherein said connector means is a twist-type garden hose connector.

11. The toy of claim 1 wherein said flexible hose is threadingly connectable to said housing.

12. The toy of claim 1 wherein said housing is generally enclosed.

13. The toy of claim 1 wherein said diffusing nozzle means includes a generally circular array of apertures and means for deflecting the liquid flow out of said apertures after the liquid flow exits from said apertures.

14. The toy of claim 13 wherein said diffusing nozzle means includes means for producing a generally vertically directed central liquid spray and means for producing a plurality of surrounding sprays arranged generally at 45 degrees to said central spray.

* * * * *